US006083092A

United States Patent [19]

Aydelott et al.

[11] Patent Number: 6,083,092

[45] Date of Patent: Jul. 4, 2000

[54] MULTI-PIECE LATHE CHUCK FOR SILICON INGOTS

[75] Inventors: Richard M. Aydelott, Ridgefield; Travis Nice; Richard Robert Brown, both of Battle Ground, all of Wash.

[73] Assignee: SEH America, Inc., Vancouver, Wash.

[21] Appl. No.: 09/439,895

[22] Filed: Nov. 12, 1999

Related U.S. Application Data

[62] Division of application No. 08/843,943, Apr. 17, 1997, Pat. No. 6,012,976.

[51] Int. Cl.[7] ..... B24B 49/00

[52] U.S. Cl. ..... 451/385; 451/379; 451/398; 451/402

[58] Field of Search ..... 451/385, 379, 451/397, 398; 125/402, 13.01; 82/1.11

[56] References Cited

U.S. PATENT DOCUMENTS

| | | | |
|---|---|---|---|
| 2,449,831 | 9/1948 | Arms et al. | 451/397 |
| 3,279,129 | 10/1966 | Ruger | 451/398 |
| 3,590,536 | 7/1971 | Fisher | 451/397 |
| 4,223,898 | 9/1980 | Righi | 451/398 |
| 5,148,652 | 9/1992 | Herzog . | |
| 5,205,080 | 4/1993 | Ibe et al. . | |
| 5,525,092 | 6/1996 | Hirano et al. . | |
| 5,586,476 | 12/1996 | Esser . | |
| 5,722,805 | 3/1998 | Giffin . | |

OTHER PUBLICATIONS

Richard M. Aydelott, Declaration, Jun. 18, 1999.

*Primary Examiner*—Eileen P. Morgan
*Attorney, Agent, or Firm*—Alston & Bird LLP

[57] ABSTRACT

Improved chucks for supporting elongate objects having conical end portions, such as single crystal ingots of semiconductor material, while such objects are held and rotated, as in a lathe. A base portion of the chuck includes bores to accept fasteners to fasten the base to a headstock or tailstock of a lathe. The base includes a receptacle for holding an annular chuck insert which has a conical socket surface to engage the body, such as a conical end portion of a single crystal ingot, to be held and rotated. Alternatively, the base may have three or more rollers spaced equally about a central axis and rotatable about roller axes all located in a plane perpendicular to the central axis.

7 Claims, 4 Drawing Sheets

MULTI-PIECE LATHE CHUCK FOR SILICON INGOTS

RELATED APPLICATION

The present application is a divisional of U.S. patent application Ser. No. 08/843,943 filed Apr. 17, 1997 now U.S. Pat. No. 6,012,976.

BACKGROUND OF THE INVENTION

The present invention relates to machines for shaping single crystal ingots, and in particular relates to a chuck for holding a conical end of such an ingot while the ingot is being rotated and machined to a desired shape.

Semiconductor substrates to be used in semiconductor integrated circuits are manufactured by centering a single crystal ingot, produced in the general shape of a round bar with tapered ends by a single crystal growing method such as the Czochralski method, grinding the generally cylindrical part of the ingot with a grinder to finish it with a prescribed diameter, and thereafter cutting the shaped ingot perpendicular to its longitudinal axis to obtain generally planar wafers, which are then further prepared to produce integrated circuits.

A single crystal ingot has generally conical end parts that are centered in a lathe, using a chuck located at each end thereof to grip the generally conical end parts so that the ingot can be ground to a required shape. In the past, chucks defining concave conical socket surfaces have been used at the headstock and the tailstock of a lathe, to hold the conical ends of a single crystal ingot.

The generally conical parts at the ends of a single crystal ingot, as a result of the process of their formation, have somewhat irregularly shaped surfaces including protruding nodes. The end portions of an ingot thus contact the interior surfaces of a conical socket portion of a lathe chuck with irregularly concentrated pressure.

Axial pressure is exerted between the tailstock and headstock of a lathe in supporting and rotating a single crystal ingot, as is explained, for example, in Hirano et al. U.S. Pat. No. 5,525,092, and such pressure brings the surfaces of the conical end portions of such a single crystal ingot against the surfaces of the chucks used to hold such an ingot in a lathe. Pressure concentrations caused by nodes in the conical end portions of such a single crystal ingot are thus imposed on the surfaces of such chucks.

The previously known chucks are of unitary construction and have axially oriented bolt holes that intersect their conical interior socket surfaces. An ingot held in such a chuck will typically slip until a node on its surface engages an open bolt hole and interlocks with it. This stops the slippage, but may often result in the ingot being located eccentrically. As machining of the ingot progresses the ingot later may slip into a different position in the chuck.

Also, because of the irregular surfaces of the conical end portions of the ingots, the surfaces of the interior of the previously used conical chucks are soon damaged, and, particularly at the margins of the holes through which bolts are inserted to fasten such chucks to the headstock or tailstock of the lathe, the deformation of the material surrounding the holes makes the chucks unsatisfactory for further use undesirably quickly, as deformities surrounding bolt holes become more likely to engage nodes.

It is necessary to center the conical ends of such single crystal ingots and to grip them securely so that the ingots can be rotated without excessive slipping and so that they can be shaped accurately into the required generally cylindrical shape in preparation to being cut into planar wafers. Using previously available chucks it has been difficult both to center an ingot accurately and to hold it securely enough to rotate it in a controlled manner so that it can be shaped as required without rapidly damaging the chuck surfaces contacted by the ingots.

When a damaged chuck is replaced it must be mounted precisely centered on the grinder lathe, or unacceptable vibration will result when ingots are rotated. The process of mounting such chucks thus takes significant amounts of time.

What is desired, then, is an improved chuck for holding an end of an object such as a single crystal ingot of a semiconductor material securely in a centered position and for transferring ample forces to such an object to rotate it as it is machined or otherwise shaped as required.

SUMMARY OF THE INVENTION

The present invention overcomes the aforementioned disadvantages and shortcomings of the prior art chucks for single crystal ingots by providing improved chucks for centering, holding, and driving a solid body having generally conical ends, and in particular for centering, holding, and driving a single crystal ingot of a material such as silicon while the ingot is shaped in preparation for further processing.

In a first embodiment of the present invention a chuck includes a base that defines holes to receive bolts to fasten the base to the headstock or tailstock of a lathe. A receptacle is defined in the base, and a chuck insert that defines a conical socket including a conical surface uninterrupted by bolt holes is held in the receptacle. The base of the chuck can be left in place on a grinder lathe while the chuck insert is removed from and replaced in the receptacle, which is already in the required location.

In one embodiment of the present invention two concentric conical socket surfaces having different cone angles are provided in the chuck insert.

In one embodiment of the present invention a chuck insert has one or more flat surfaces on an otherwise generally cylindrical peripheral surface, and setscrews are provided in the base to retain the chuck insert in the receptacle defined by the base.

In another embodiment of the invention a chuck includes a base and at least three rollers are mounted on the base so as to urge a generally conical end of an object such as a single crystal ingot into a central location, aligned with the central axis of the base.

In one such embodiment of the invention such rollers preferably have surfaces intended to grip the surface of such a conical end of an object securely enough to impart necessary torque to rotate the object.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
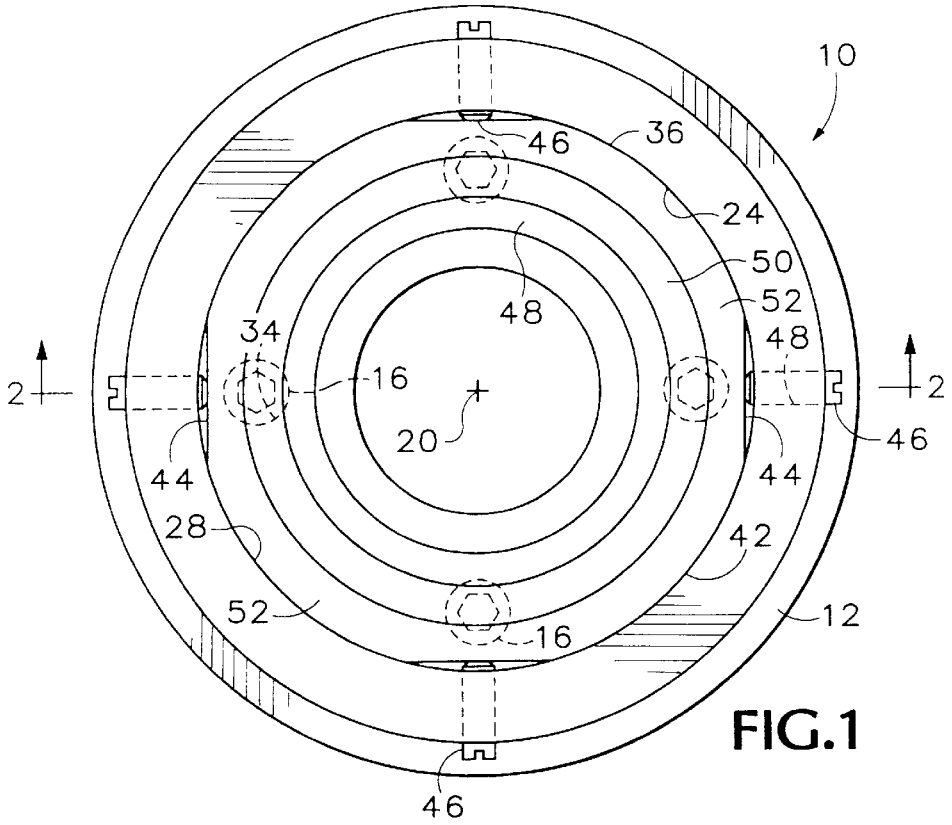
FIG. 1 is a front face view of a multi-piece lathe chuck for silicon ingots, embodying the present invention.
Figure 2:
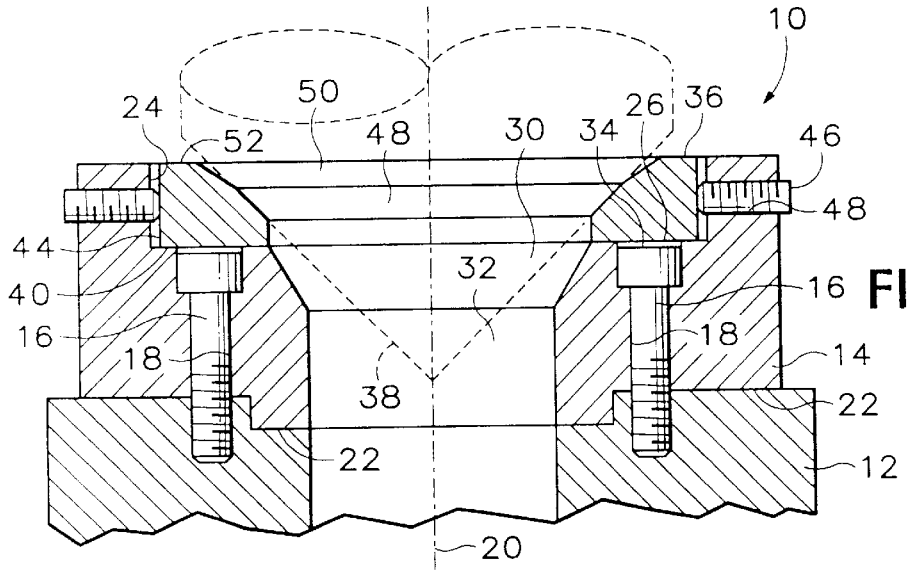
FIG. 2 is a section view taken along line 2—2 of FIG. 1, including a portion of a drive plate of a lathe headstock.

Referring first to FIGS. 1 and 2 of the drawings, a chuck 10 is shown mounted on a drive plate 12 of the headstock of a lathe, for securely holding and rotating single crystal ingots of silicon as they are shaped to prepare the ingots for being sliced into semi-conductor wafers, for example. The chuck 10 has a base 14 fastened to the drive plate 12 by suitable fasteners such as four bolts 16 extending through bolt holes 18 defined in the base 14 and extending parallel with the central axis 20 of the chuck 10, which is coincident with the axis of rotation of the lathe of which the drive plate 12 is a part. An inner end 22 of the base 14 is shaped appropriately to fit tightly against the drive plate 12 for rotation with it. Similarly, a chuck 10 could be mounted on a mounting plate (not shown) mounted for rotation at the tailstock of the lathe.

The base 14 includes a centrally located receptacle 24 in the form of a generally cylindrical cavity defined by a planar bottom 26 and a cylindrical inner wall surface of a side wall 28. A conical throat 30 leads to a central bore 32 that coincides with a central bore in the drive plate 12, although such coincidence is not necessary. The heads of the bolts 16 are recessed into the bottom 26 in counterbores 34.

A chuck insert 36 is located within the receptacle 24 of the base 14. The chuck insert 36 is an annular piece cast or machined of a suitably hard and tough metal, such as steel, capable of withstanding the pressures to be exerted upon it by a conical end portion 38 of a single crystal ingot of a semi-conductor material. The chuck insert 36 has a flat annular bottom face 40 that rests on the bottom 26 of the receptacle 24 in the base 14. An outer peripheral surface 42 is generally cylindrical and fits in snug sliding contact with the cylindrical inner surface of the side wall 28 within the receptacle 24 so that the chuck insert 36 is concentric with the receptacle 24. Four flat surfaces 44 parallel with the central axis 20 interrupt the outer peripheral surface 42 at evenly spaced locations, where a respective setscrew 46, extending radially inward through the side wall 28 of the base in mating engagement with threads defined in a bore 48, engages each of the flat surfaces 44. Each of the setscrews 46 is tightened against a corresponding one of the flat surfaces 44 to hold the chuck insert 36 securely in place within the receptacle 24 so that it rotates with the base 14 as it is driven by the drive plate 12.

The chuck insert 36 defines a pair of concentric annular conical ingot support surfaces 48 and 50, with the second, or outer conical support surface 50 having a wider cone angle and extending to a planar outer face 52 of the chuck insert 36, to enable it to accept and support a conical end portion 38 of an ingot of greater diameter or stubbier shape. The conical interior ingot support surfaces 48 and 50 are continuous. That is, neither is interrupted as by bolt holes which are present in such a surface in a chuck of a previously known type. As a result, protruding nodes on the surface of a conical end portion 38 of an ingot are uniformly supported in the chuck 10 by contact against the support surfaces 48 and 50, and the conical end portion 38 is not prevented from moving into the desired central location in the chuck insert 36.

Figure 3:
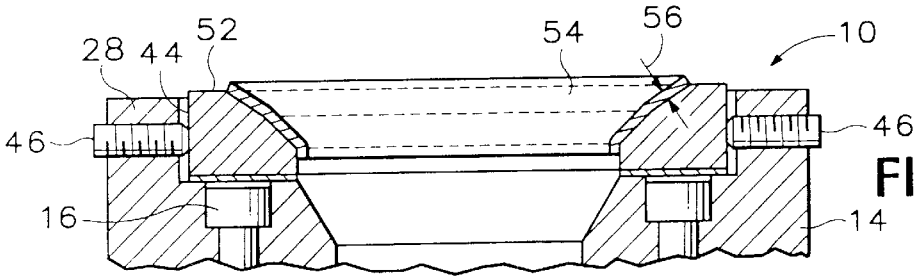
FIG. 3 is a view similar to a portion of FIG. 2, showing a gasket in place on the chuck.

Referring also to FIG. 3, a gasket 54, preferably manufactured of a pliable and compressible sheet material, is shown attached to the socket portion of the chuck insert 36, by a layer of an adhesive material (not shown) holding the gasket in place on the conical annular ingot support surfaces 48 and 50. Such a gasket could be made of various kinds of flexible material including various synthetic plastics, or rubber, and ordinary red rubber gasket material has been found acceptable. While such a gasket 54 is not necessary, its use offers some advantages. Preferably, such a gasket has a thickness 56 which is ample to protect the support surfaces 48 and 50, at least partially, from being damaged by the nodes of the conical end portion 38 of a single crystal ingot. The gasket 54 also increases the effective coefficient of friction between the socket portion of the chuck insert 36 and the surface of the conical end portion 38, in order better to impart rotation to the ingot. The thickness 56 may, for example, be within the range of about 0.5 mm and 7.0 mm, depending on the material. The gasket 54 preferably has a layer of an appropriate adhesive, such as a commonly available film of flexible plastic material with an adhesive coating on each face, on a side which mates against the support surfaces 48 and 50, and thus can easily be removed and replaced as frequently as necessary.

Figure 4:
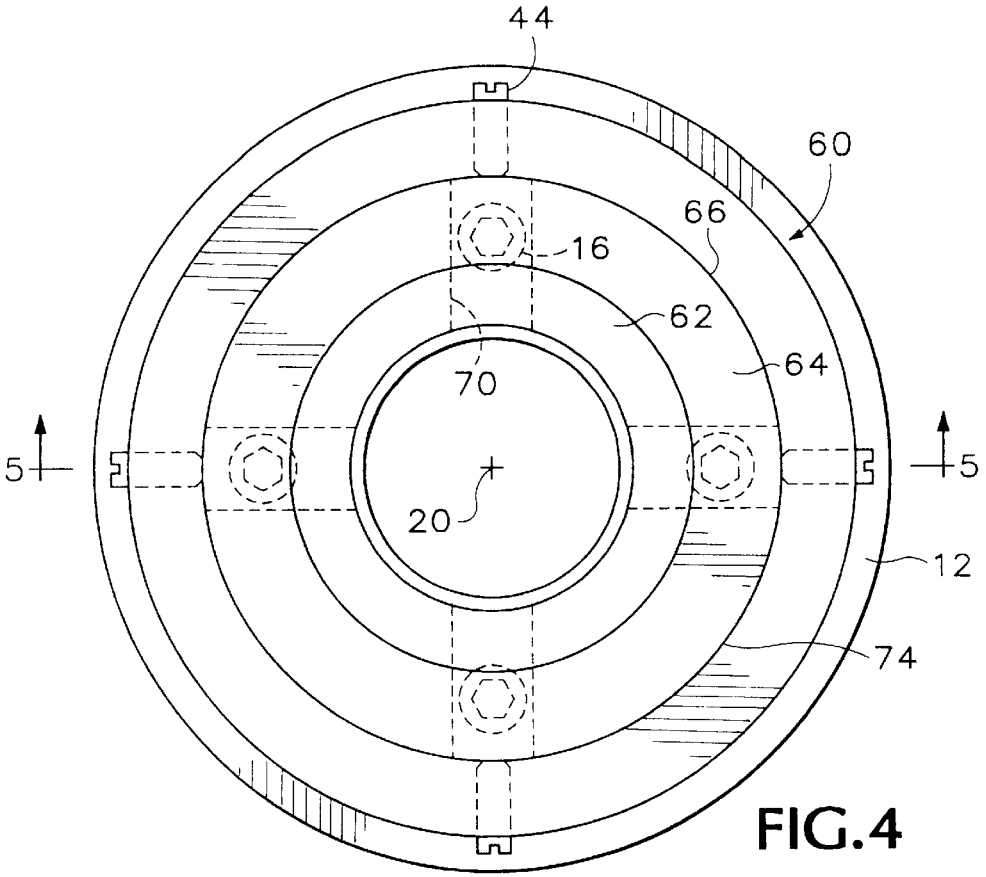
FIG. 4 is a view similar to that of FIG. 1 showing a chuck which is a somewhat different embodiment of the invention.
Figure 5:
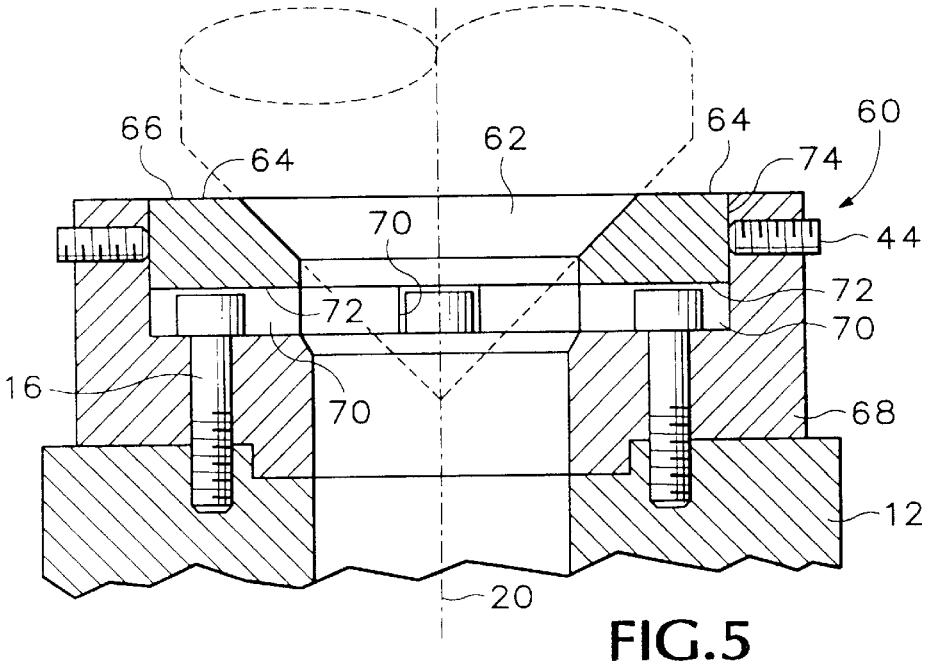
FIG. 5 is a section view of the chuck shown in FIG. 4, taken along line 5—5 of FIG. 4.

As shown in FIGS. 4 and 5, a chuck 60 is in many respects similar to the chuck 10, but it includes only a single annular conical interior ingot support surface 62, extending from an outer face 64 inwardly toward the drive plate 12 and the central axis 20, in a chuck insert 66. A base 68 of the chuck 60 is in most respects similar to the base 14, but instead of counterbores 34, slots 70 are provided to provide clearance for the heads of the bolts 16 or similar fasteners, thus interrupting the bottom 26 of the receptacle 24 and dividing it into four separated segments which support the bottom face 72 of the chuck insert 66. The slots 70 are also available for use, if necessary, to give access to the bottom face 72 for pulling the chuck insert 66 from the receptacle 24.

The outer peripheral surface 74 of the chuck insert 66 has no flats, and so the setscrews 44 engage the outer peripheral surface 74 regardless of the position of rotation of the chuck insert 66 about the central axis 20 with respect to the base 68.

In either the chuck 10 or the chuck 60, replacement of the chuck insert 36 or 66 when the interior ingot support surfaces 48, 50, or 62 have eventually become damaged is simpler and quicker than replacement of an entire chuck since the base 14 or 68 can remain located properly on the drive plate 12.

Figure 6:
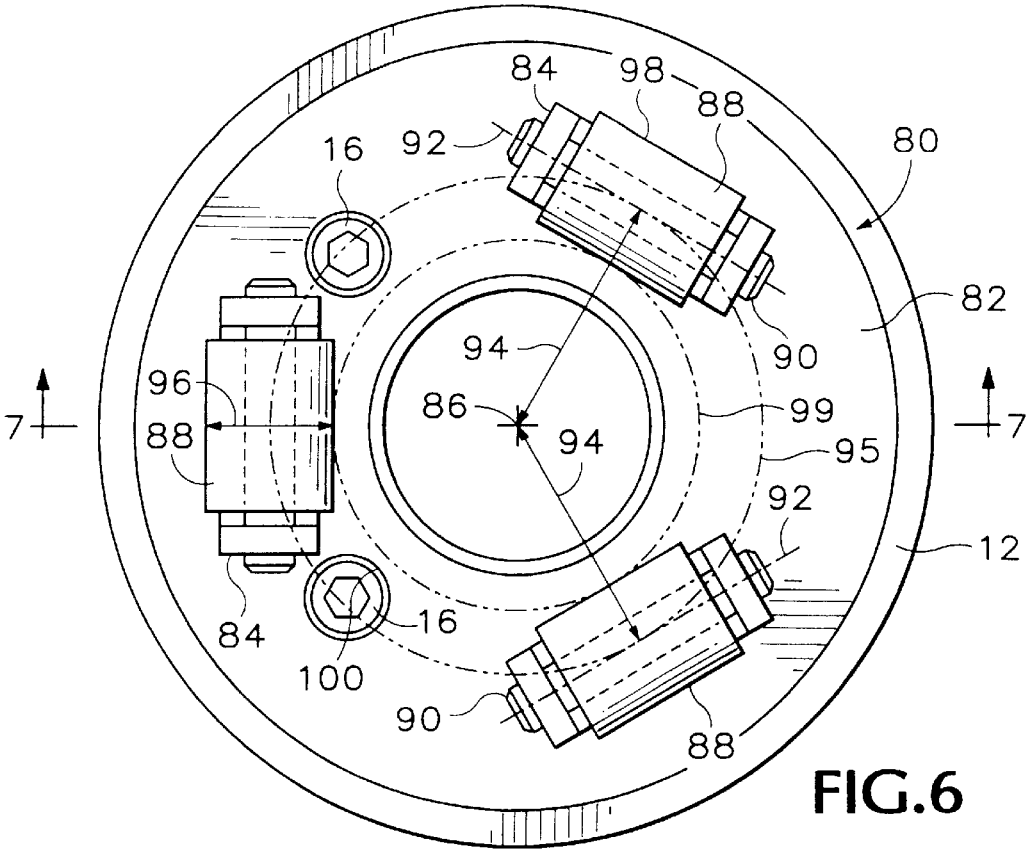
FIG. 6 is a front face view of a lathe chuck which is a different embodiment of the present invention.
Figure 7:
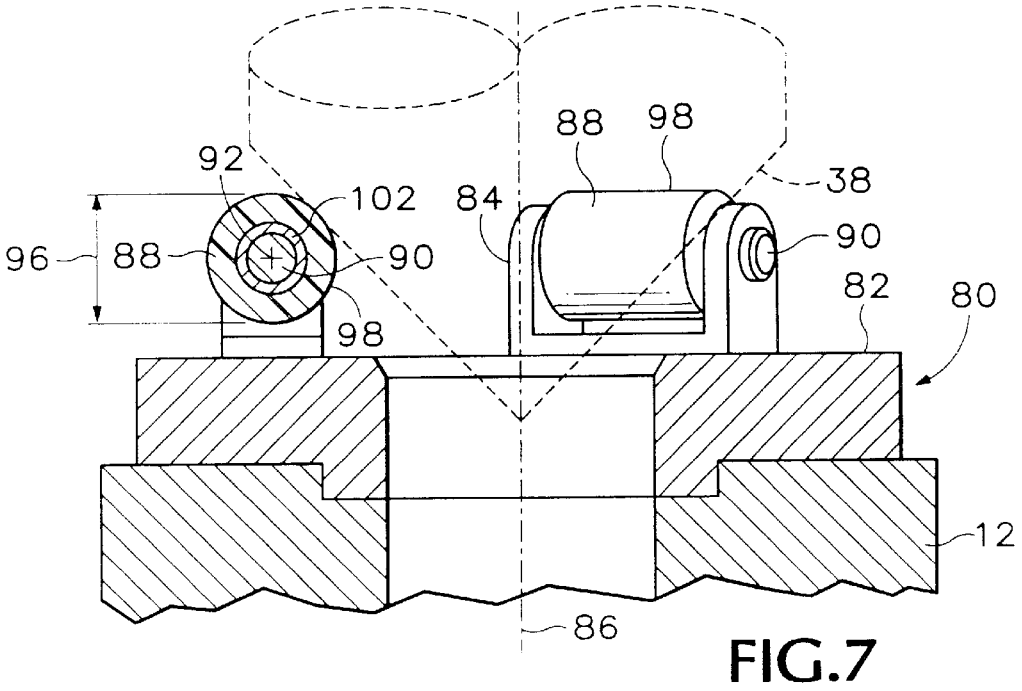
FIG. 7 is a section view of the lathe chuck shown in FIG. 6, taken along line 7—7 of FIG. 6.

A chuck 80, shown in FIGS. 6 and 7, includes a base 82 on which three pairs of pillow blocks 84 are located, attached to the base 82 by suitable fasteners (not shown) or by other means, and separated from one another at equal angles and distances about and from a central axis 86. Each pair 84 of pillow blocks supports a respective roller 88 on a roller pin 90, with all of the roller pins 90 having respective axes 92 parallel with a plane perpendicular to the central axis 86. Preferably, the respective distances 94, between the central axis 86 and each roller pin axis 92, are equal so that the axes 92 are all tangent to an imaginary circle 95 in a plane perpendicular to the central axis 86 and centered on the central axis 86. Preferably, the diameters 96 of the cylindrical outer surfaces 98 of the several rollers 88 and the central axis 86 are equal so that the surface 98 are tangent to a circle 99 concentric with the circle 95. As with the chucks 10 and 60, the chuck 80 is attached to a drive plate 12 or the like by bolts 16, recessed into the base 82 in counterbores 100 and extending parallel with the central axis 86 and engaged in the drive plate 12. When the conical end portion 38 of an ingot encounters the outer surfaces 98 of the several rollers 88 the rollers 88 urge the conical end portion 38 to align itself coaxially with the central axis 86 as axial force toward the chuck 80 is applied to a semiconductor ingot, and the pressure of the cylindrical outer surfaces 98 of the rollers 88 against the conical end portions 38 of the ingot will provide sufficient frictional force for rotating the ingot as required. Each of the rollers 88 may be of a polyurethane or other strong synthetic plastic material surrounding a bushing 102 of metal which is rotatable around the respective roller pin 90 to allow an ingot to move into a centrally aligned position as shown in FIG. 7.

A chuck 108 is generally similar to the chuck 80, but includes four rollers 110 in its base 112. Fasteners such as bolts 114 located in counterbores 116 in the base 112 are used to fasten the base 112 to the drive plate 12 for rotation of the chuck 108 about a central axis 118 coinciding with the axis of rotation of the drive plate 12. A central recess 120 is formed, as by milling, in the base 112 and has the shape of a cross intersecting a circle which is concentric with the central axis 118. Four intersecting roller pin bores 122 are all located in a single plane oriented perpendicular to the central axis 118. The pin bores 122 are arranged in two pairs of parallel bores, with each roller pin bore 122 intersecting one of the cross arms of the recess 120.

Figure 8:
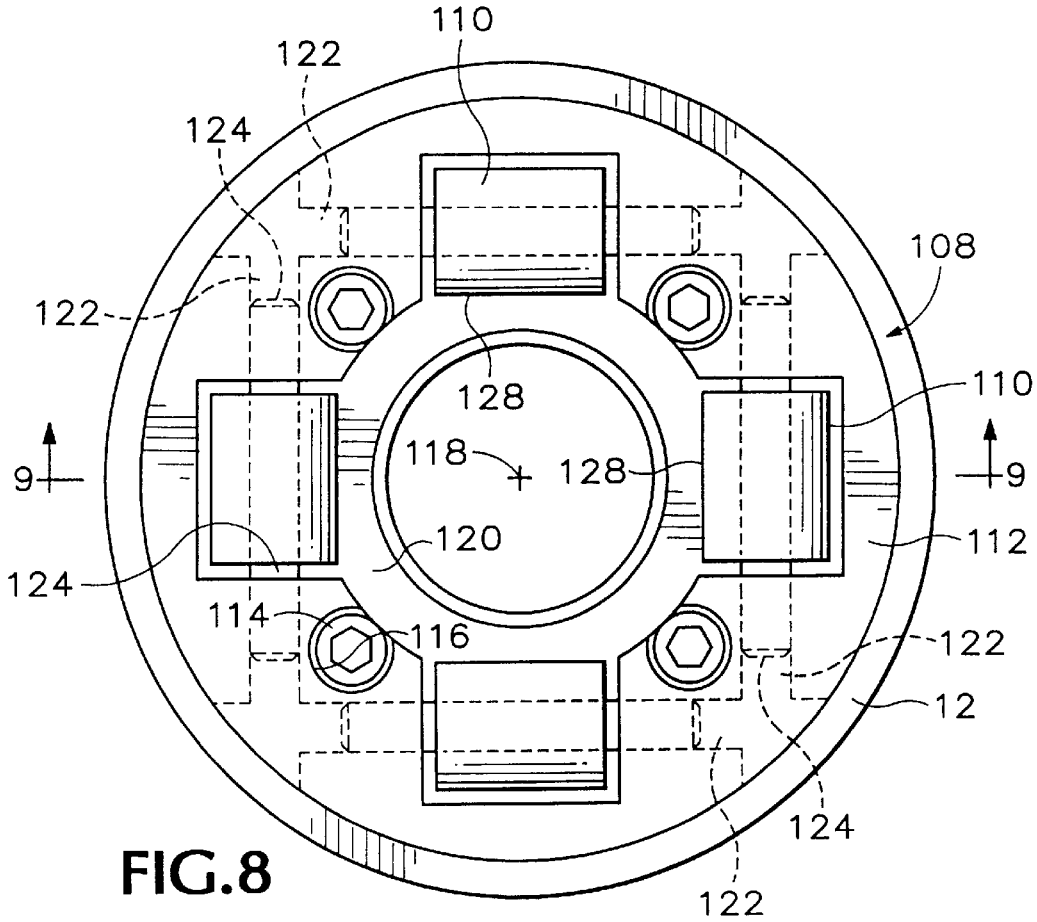
FIG. 8 is a front face view of a lathe chuck which is yet a further embodiment of the present invention.

Each roller pin bore 110 extends entirely through the base 112, as may be seen best in FIG. 8, and a roller pin 124 is located within each roller pin bore 122, with a respective roller 110 supported rotatably on each roller pin 124. The rollers 110 are fixed with respect to the roller pins 124 and the roller pins 124 are fixed with respect to the bores 122 by conventional means.

Each roller 110 has a generally cylindrical outer surface 128 which intrudes within a portion of the circular central part of the recess 120. The rollers 110 are of equal size and the roller pin bores 122 are spaced equally distant from the central axis 118, so that the outer surfaces 128 of the several rollers 110 are all separated equally from one another and from the central axis 118. As a result, the generally conical outer end 38 of a single crystal ingot is urged into a central position aligned with the central axis 118 when placed between a pair of such chucks 108 located respectively at the opposite ends of a grinder lathe to support and rotate such an ingot.

Figure 9:
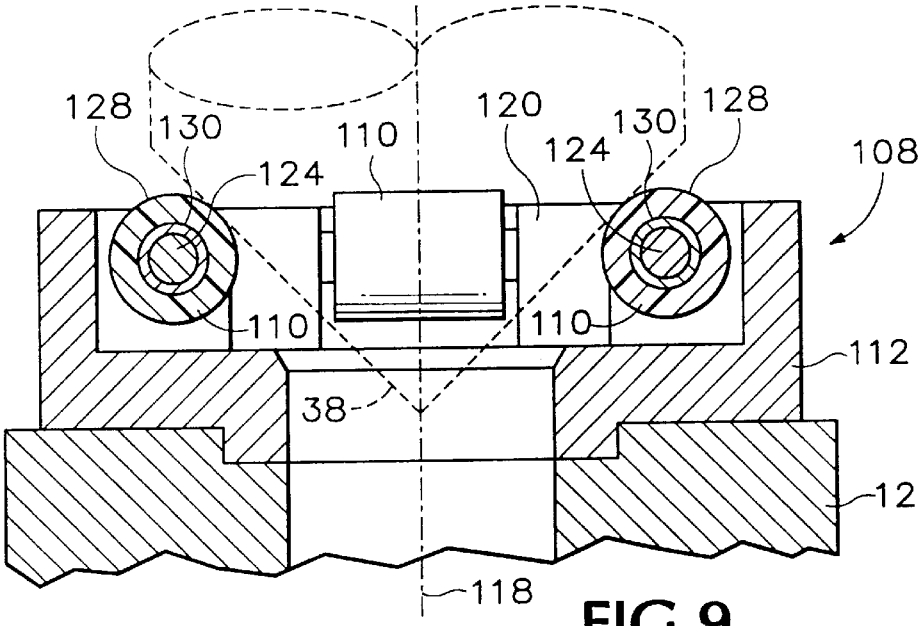
FIG. 9 is a section view of the lathe chuck shown in FIG. 8, taken along line 9—9 of FIG. 8.

Each of the rollers 110 may be of a polyurethane or other strong synthetic plastic material surrounding a bushing 130 which is rotatable about the respective roller pin 124 to allow an ingot to move into position to be supported in the chuck 108 as shown in FIG. 9.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A chuck for receiving a generally conical end of an ingot to support and rotate the ingot during a process of shaping a peripheral surface of the ingot, comprising:

(a) a base having a central axis and defining a plurality of fastener holes for use in fastening said base to a lathe; and (b) at least three rollers, each mounted rotatably on said base and spaced apart from each other about said central axis.

2. The chuck of claim 1, including at least four of said rollers arranged in pairs of diametrically opposite ones of said rollers.

3. The chuck of claim 2 wherein each of said rollers has an axis of rotation, the axes of rotation of both rollers of each pair being in a single plane perpendicular to said central axis.

4. The chuck of claim 1, wherein each of said rollers has an axis of rotation extending tangentially with respect to a circle centered on said central axis of said base.

5. The chuck of claim 1, wherein each of said rollers has an axis of rotation and all of said axes of rotation are in a single plane perpendicular to said central axis.

6. The chuck of claim 5 wherein each of said rollers has a surface located tangent to a circle that is concentric with said central axis and located in said single plane.

7. A chuck for receiving and supporting a generally conical end of an elongate object and gripping the object during a process of shaping a surface of the object, comprising:

(a) a base having a central axis and defining a plurality of fastener holes for use in fastening said base to a lathe; and (b) at least three rollers, each mounted rotatably on said base and spaced apart from each other about said central axis.

* * * * *

UNITED STATES PATENT AND TRADEMARK OFFICE

CERTIFICATE OF CORRECTION

PATENT NO. : 6,083,092

DATED : July 4, 2000

INVENTOR(S) : Aydelott et al.

It is certified that error appears in the above-identified patent and that said Letters Patent is hereby corrected as shown below:

Title page, Related U.S. Application Data, item 62, and Column 1, line 6:

"08/843,943" should read --08/843,934--.

Signed and Sealed this

Twelfth Day of December, 2000

*Attest:*

Q. TODD DICKINSON

*Attesting Officer*

*Director of Patents and Trademarks*